United States Patent [19]

Turner

[11] Patent Number: 4,939,986

[45] Date of Patent: Jul. 10, 1990

[54] EXHAUST VENTILATOR

[75] Inventor: Charles R. Turner, Decatur, Ala.

[73] Assignee: John C. Garvin, Jr. & Harold W. Hilton, Huntsville, Ala.

[21] Appl. No.: 318,850

[22] Filed: Mar. 6, 1989

[51] Int. Cl.[5] ..... F24F 7/007; F24F 13/18

[52] U.S. Cl. ..... 98/42.1; 98/42.06; 98/116; 98/900

[58] Field of Search ..... 98/42.02, 42.04, 42.06, 98/42.07, 42.1, 42.11, 42.12, 116, 900, 119

[56] References Cited

U.S. PATENT DOCUMENTS

| | | | |
|---|---|---|---|
| 501,253 | 7/1893 | Hetzer | 98/119 |
| 2,049,856 | 8/1936 | Mueller | 98/118 X |
| 2,638,836 | 5/1953 | Hull | 98/42.1 X |
| 2,784,661 | 3/1957 | Jenin | 98/42.1 X |
| 3,124,053 | 3/1964 | Zahn et al. | 98/119 X |
| 3,199,433 | 8/1965 | Busma, Jr. | 98/42.06 |
| 3,220,079 | 11/1965 | Aggson | 98/118 X |
| 3,324,784 | 6/1967 | Lambie et al. | 98/42.12 |
| 3,472,150 | 10/1969 | Strawsine | 98/116 |
| 4,441,404 | 4/1980 | Simon | 98/118 X |
| 4,766,806 | 8/1988 | Tomiser, Jr. et al. | 98/42.1 |

FOREIGN PATENT DOCUMENTS

| | | | |
|---|---|---|---|
| 1264017 | 3/1968 | Fed. Rep. of Germany | 98/118 |
| 1330148 | 5/1963 | France | 98/118 |
| 31835 | 2/1986 | Japan | 98/900 |
| 1198213 | 7/1970 | United Kingdom | 98/42.07 |

*Primary Examiner*—Harold Joyce

*Attorney, Agent, or Firm*—John C. Garvin, Jr.; Harold W. Hilton

[57] ABSTRACT

A ventilator assembly for attachment in an opening in a partition such as a ceiling of a structure such as a dwelling. The ventilator assembly includes a housing having an elongated body portion of sufficient length to extend through insulation which may be disposed adjacent the partition. A first removable cap member having a central opening therethough is disposed on a first end of the housing and a second removable cap member is secured to a second end of the housing. The second cap member is provided with air inlet means having a grill secured thereover. In one embodiment of the invention, a filter is provided in the grill of the air inlet means and in the removable first cap member. Additionally, activated carbon filters are provided in the interior of the housing. In a second embodiment, the removable first cap member supports an electric motor and exhaust fan therein and a movable baffle is mounted in the housing adjacent the air inlet means of the second cap member. This assembly may be powered by solar energy or other readily available electrical sources.

8 Claims, 3 Drawing Sheets

EXHAUST VENTILATOR

FIELD OF INVENTION

This invention relates to a ventilator for venting tightly closed structures and particularly to such a ventilator having two-way filtering means for trapping unpleasant odors, pollutants and particulates and also providing for the structure to be vented.

BACKGROUND OF THE INVENTION

Building structures that are tightly sealed permit very little, if any, air flow, therefore, permitting polluted air and gases to accumulate therein. However, it is desirable that such polluted air and gases be allowed to escape or be withdrawn even while the structure is closed and tightly sealed.

It is, therefore, an object of the present invention to provide a ventilator system to vent polluted air and gases from buildings and the like and to provide for replacement of the vented air with clean filtered air.

It is a further object of the present invention to provide such a ventilator system with a filtering means which will effectively trap unpleasant odors, pollutants, and particulates while permitting air flow through the ventilator system.

It is yet a further object of the present invention to provide such a ventilator system which will permit filtered air to enter a tightly closed compartment and also permit polluted air and gases to be exhausted from the compartment.

It is still a further object to provide such a ventilator system in which the means for exhausting the air and gases from the enclosed compartment is powered by solar energy.

DESCRIPTION OF THE PREFERRED EMBODIMENT

Figure 1:
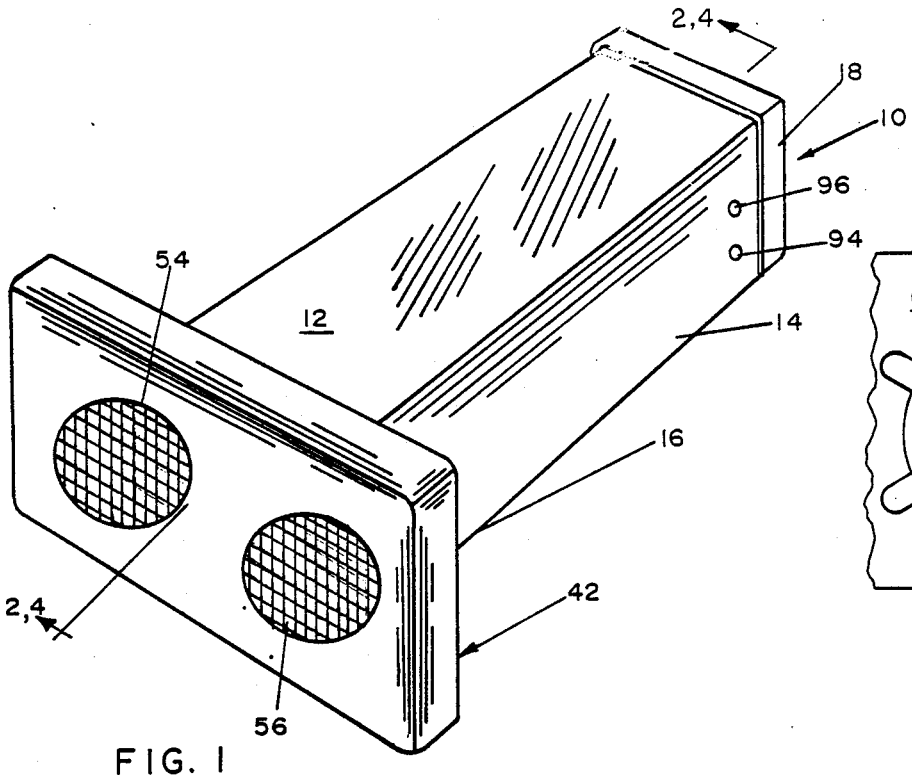
FIG. 1 is a pictorial view of the ventilator of the present invention.
Figure 2:
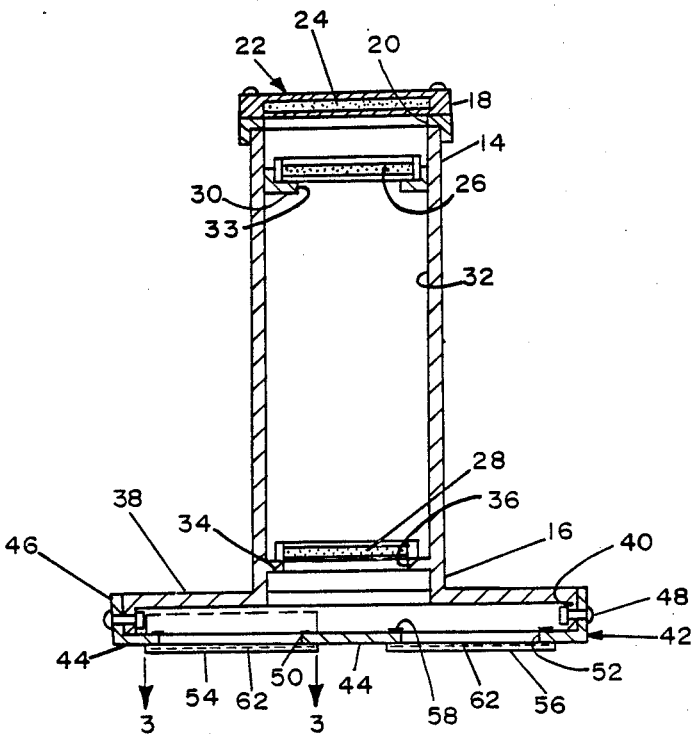
FIG. 2 is a sectional view taken along line 2—2 of FIG. 1.

FIG. 1 is a pictorial view of the ventilator assembly of the present invention. As seen in FIG. 1, the ventilator 10 includes a housing 12, preferably made of ABS plastic flame retardant material, and having an upper and lower section 14 and 16. An upper housing cap 18 is provided at the upper section 14 of the housing. Cap 18 is preferable made of the same material as the housing. A plastic guard 22 may be secured to the upper surface of cap 18. As seen in FIG. 2 cap 18 is provided with an opening 20 having the plastic guard 22 mounted thereover. A removable dust filter 24 is shown mounted in guard 22. The guard is generally comprised of upper and lower members having the filter mounted therebetween.

A pair of filters 26 and 28 are mounted in housing 12. The filters are typically comprised of a layer of an activated carbon filter element enclosed in an aluminum grid. A typical carbon filter is manufactured by Columbus Industries, Inc. and identified as Polysorb TM. Filter 26 is mounted in upper section 14 of housing 12 and is secured to an upper filter support or bracket 30 forming a part of or secured to the interior 32 of housing 12. An opening 33 is provided in support 30. Filter 28 is secured to a lower filter support or bracket 34 forming a part of or secured to the interior 32 of housing 12. An opening 36 is provided in lower support 34. The lower section 16 of housing 12 includes a flanged or outwardly extending portion 38 having a downwardly extending surface 40. A lower cap 42 is provided and includes a lower surface 44 having an upwardly extending lip portion 46 which is disposed around the downwardly extending surface 40 of flanged portion 38 and is secured thereto by screws 48.

Figure 3:
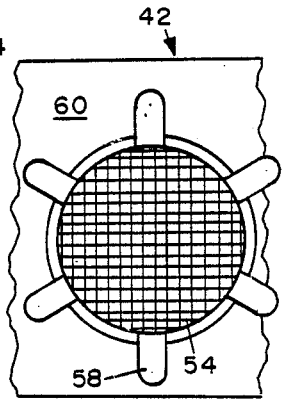
FIG. 3 is a view taken along line 3—3 of FIG. 2 illustrating the tabs for securing the grill in the ventilator housing.

A pair of openings 50 and 52 are provided in spaced relation in lower cap 42 and a pair of aluminum grills 54 and 56 are respectively secured in openings 50 and 52 by a plurality of tabs 58 which are bent for contact with the inner surface 60 of cap 42, (FIG. 3). Dust filters 62 are provided in grills 54 and 56.

In the embodiment described above and illustrated in FIGS. 1-3, the ventilator does not use a motor to draw air out of an enclosed space such as a room, etc., but relies upon the characteristic of the air to rise and, therefore, pass through the unit. The ventilator provides for removal of gaseous, stagnant, odorous air from the enclosed space (such as a room) and replenishes it with clean filtered air. Additionally, as air is circulated above the upper end 14 of the ventilator (in the attic, for example) it withdraws or aspirates the air from the enclosed space (room) through the ventilator. Also, filters 26 and 28 are two-way activated carbon filters which, in tightly sealed houses, will permit air flow back into the room while retaining odors, particulates and impurities in its absorptive structure.

Figure 4:
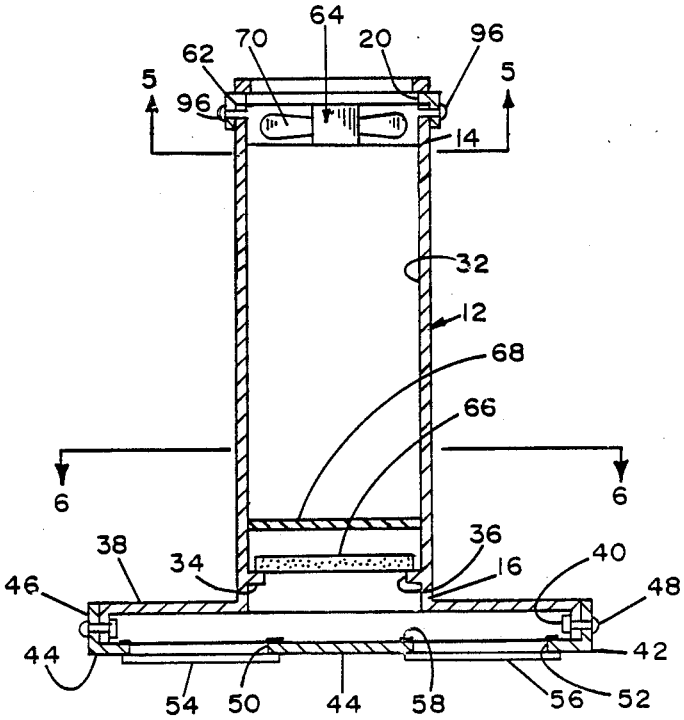
FIG. 4 is a sectional view similar to FIG. 2, illustrating an embodiment in which an electric motor and baffle is used.

In a second embodiment, illustrated in FIGS. 1 and 3-9, wherein like reference numerals refer to like parts, an exhaust motor is used to withdraw the air. FIG. 4 is a sectional view taken along line 4—4 of the housing of FIG. 1 and illustrates the housing to be similar to the housing of the first embodiment (shown in FIGS. 1-3) but whith an exhaust fan and baffle therein. In this embodiment dust filters are generally not provided in grills 54 and 56.

Figure 7:
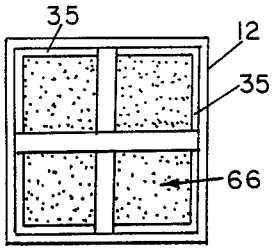
FIG. 7 is a view similar to FIG. 6 illustrating another arrangement of the restraining device for the movable baffle shown in FIG. 6.
Figure 6:
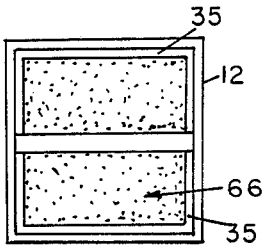
FIG. 6 is a view taken along line 6—6 of FIG. 4.

As seen in FIG. 4 the upper section 14 of the housing supports a cap 62 in which an electric motor 64 is mounted. The motor is a 12 volt, four inch axial fan motor of the type Sunon or Dayton manufactured by W. W. Grainger, Inc. Additionally, a baffle 66 rests on support 34 in lower housing section 16 and is comprised of a flame retardant polyfoam which is large enough to cover the opening 36 and small enough for movement in the housing. As seen in FIGS. 4, 6, and 7, a space 35 is provided between the baffle and the interior or inner surface 32 of housing 12. A restraining device such as a strap 68 is provided above baffle 66 (FIGS. 4, 6 and 7)

to limit the upward movement thereof in a manner described hereinbelow.

Figure 5:
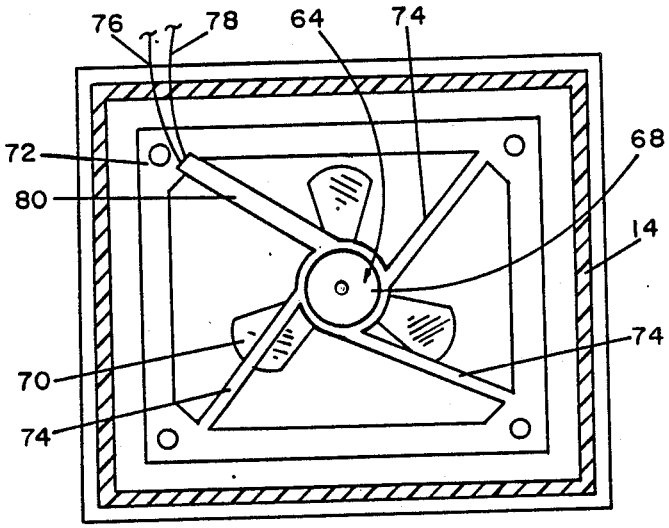
FIG. 5 is a sectional view taken along line 5—5 of FIG. 4.

FIG. 5 illustrates the mounting of motor 64 in the cap. The motor is provided with an annular rotor housing 68 having fan blades 70 mounted thereon. The motor is mounted in a frame 72 and supported therein by a plurality of radially extending members 74. The lead-in wires 76 and 78 are supported in a radially support member 80. Frame 72 is secured to cap 18 by bolts (not shown).

Figure 8:
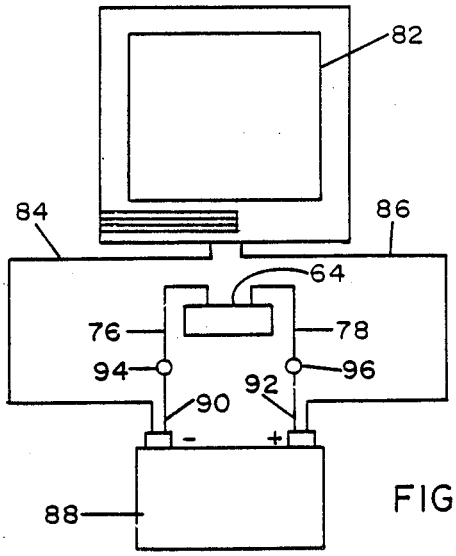
FIG. 8 is a diagrammatic view of the photovoltaic power source arrangement.

Power to operate the unit is preferably generated by a photovoltaic (solar) panel 82 (FIG. 8). As seen in FIG. 8, leads 84 and 86 extend from the solar panel 82 to a battery 88 and leads 90 and 92 extend from battery 88 for connection to terminals 94 and 96 mounted on upper section 14 of housing 12 (FIG. 1). The motor's electrical leads 76 and 78 are also connected to terminals 94 and 96. It is to be understood that while a battery is described as storing, receiving and converting the energy from the solar panel to D.C. voltage, other energy storage and converting devices may be resorted to if desired.

The photovoltaic panel typically is rated at 5 watts with a 14.5 voltage rating and may be similar to such solar panels which are manufactured by Arco Solar, Inc. of Camarillo, Calif.

Figure 9:
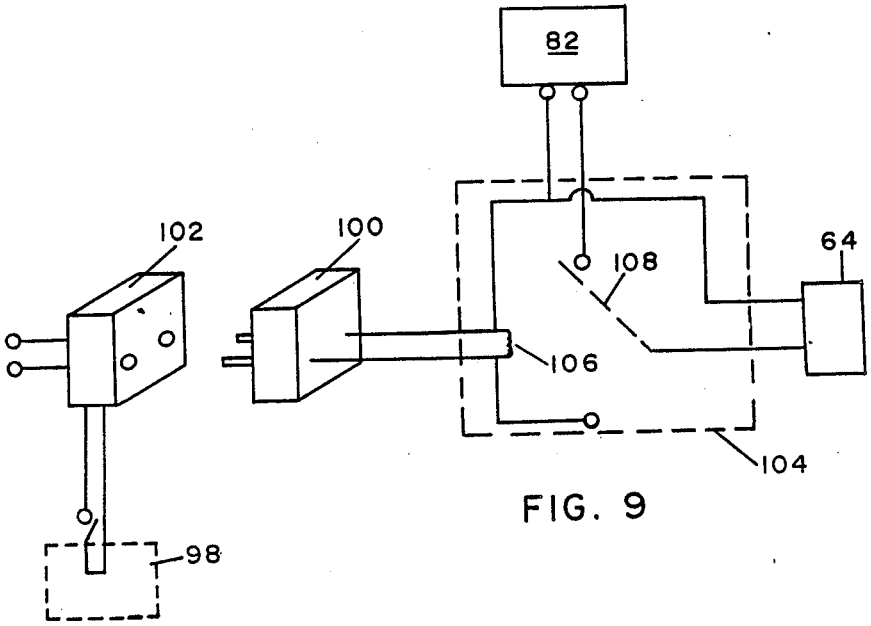
FIG. 9 is a diagrammatic view of an auxiliary power source for energizing the device illustrated in FIG. 4.

If desired, a 12 volts DC electrical auxiliary power supply control circuit may be provided to operate the unit when sun is not available. The auxiliary power control unit is illustrated in FIG. 9. A wall switch 98 controls the circuit which includes a 12 volts DC plug in transformer 100 which is adapted to be plugged into a receptable 102 connected to a source of electricity (typically 120 v.). The transformer is connected to the photovoltaic module 82 and to the fan motor 64 through a 12 volts DC DPST plug-in relay assembly 104 which includes a relay coil 106 and a switch 108. The unit is controllable from constant on to automatic position. When the 120 volts are turned off by switch 98, the relay 104 will close the circuit to the photovoltaic electric module 82 which will then operate the fan. When the wall switch is turned on the 120 volts will operate the fan motor 64 through transformer 100. It is to be understood that in lieu of the 12 volts DC electrical systems described above, a 120 volts AC electrical motor may be used and powered by a typical 120 volt AC electrical supply system.

In the operation, the motor is actuated and the fan rotates to draw polluted air from the room. Suction, caused by rotation of the blades, lifts the baffle 66 away from opening 36 provided in support 34 to permit air to be drawn through space 35 between the edges of the baffle and the interior surface 32 of the housing. The baffle is restrained from excessive movement by the restraining strap 68 and upon deenergization of the motor returns to its original position to cover opening 36.

The housing 12 of the ventilator of the present invention is typically 16 inches high and 5½ inches square. The bottom cap 42 is typically 7½ inches wide and 10 inches long resulting in a very lightweight, compact assembly which may be readily mounted directly to a sheetrock type ceiling either as a new construction or as an add-on. The 16 inches of length provides for the ventilator to extend even through the thickest insulation above the ceiling. While the housing is shown and described to be rectangular, the invention is not to be so limited as, obviously, the housing may be provided with a circular configuration, if desired.

It is to be understood that the ventilator assembly of the present invention is sufficiently light-weight enough to be secured to a somewhat thin partition, sheetrock or similar types of generally non-supportive material. To secure the device to the partition, screws, anchor bolts, etc., are extended through the flanged portion 38 of the housing and into the partition.

It is to be understood that applicant has provided a compact, lightweight ventilator system which may be installed in a rapid and facile manner. It is to be also understood that the embodiments disclosed herein are only exemplary of the contemplated invention and should not be held in a limiting sense as other modifications may be resorted to that are within the scope of the appended claims.

I claim:

1. A ventilator assembly disposed for secured relation to a partition having an air opening therein, said ventilator assembly comprising:

a housing vertically disposed for passage of air therethrough, said housing having an elongated body portion provided with first and second end sections, said elongated body portion disposed for extending into said opening in said partition;

a first cap member removably secured to said first end section, said cap member having an opening for communication with the interior of said housing;

a second cap member removably secured in said second end section, said second cap member having air inlet means therein, said air inlet means disposed in communication with the interior of said housing;

an electric motor having blades secured thereto, and said motor mounted adjacent said first section of said housing and a source of electric energy connected to said electric motor for actuation thereof for rotation of said blades to exhaust air through said housing;

baffle means including a flexible member movably carried in unsecured relation to said housing intermediate said electric motor and said air inlet means;

support means for supporting said baffle member in said housing, said support means including an inwardly extending flange portion forming a central opening for passage of air therethrough, said baffle member disposed in loosely seated relation on said flange portion over said central opening and disposed for upward displacement from a closed seated position over said opening to an open position away from said opening responsive to entrainment of air past said baffle member as a result of blade rotation by said motor; and restraining means disposed in spaced relation above said baffle member to limit said displacement thereof and to provide for said loosely seated relation of said baffle member on said flange portion.

2. A ventilator assembly as set forth in claim 1 wherein said baffle means is defined by a flexible polyfoam member.

3. A ventilator assembly as set forth in claim 1 wherein said electric source includes photovoltaic means having electric energy storage means connected thereto, said electric motor being connected to said energy storage means.

4. A ventilator assembly as set forth in claim 2 wherein said restraining means includes at least one member secured in said second section of said housing and extending over said polyfoam member to limit the movement thereof.

5. A ventilator assembly as set forth in claim 4 wherein said electric motor is mounted in said first removable cap member.

6. A ventilator assembly as set forth in claim 5 including a guard member mounted on said first cap member over said motor for protection thereof.

7. A ventilator assembly as set forth in claim 6 wherein said air inlet means includes a pair of spaced openings in said second cap.

8. A ventilator assembly as set forth in claim 7 wherein said openings are each provided with a grill thereover.

* * * * *